US008746806B2

(12) United States Patent
Lehnert et al.

(10) Patent No.: US 8,746,806 B2
(45) **Date of Patent: *Jun. 10, 2014**

(54) BIT HOLDER AND BASE PART

(75) Inventors: Thomas Lehnert, Oberraden (DE); Karsten Buhr, Willroth (DE); Cyrus Barimani, Koenigswinter (DE); Guenter Haehn, Koenigswinter (DE)

(73) Assignee: Wirtgen GmbH (DE)

( * ) Notice: Subject to any disclaimer, the term of this patent is extended or adjusted under 35 U.S.C. 154(b) by 460 days.

This patent is subject to a terminal disclaimer.

(21) Appl. No.: 12/960,756

(22) Filed: Dec. 6, 2010

(65) Prior Publication Data

US 2011/0148178 A1 Jun. 23, 2011

(30) Foreign Application Priority Data

Dec. 17, 2009 (DE) ..... 10 2009 059 188

(51) Int. Cl.
*E21C 35/18* (2006.01)

(52) U.S. Cl.
USPC ..... 299/102; 299/106

(58) Field of Classification Search
CPC ..... E21C 35/1936
USPC ..... 299/102, 106
See application file for complete search history.

(56) References Cited

U.S. PATENT DOCUMENTS

| | | | | |
|---|---|---|---|---|
| 3,498,677 | A | 3/1970 | Morrow | |
| 3,992,061 | A | 11/1976 | Rollins | |
| 4,240,669 | A * | 12/1980 | Rollins | 299/102 |
| 4,275,929 | A * | 6/1981 | Krekeler | 299/102 |
| 4,302,055 | A * | 11/1981 | Persson | 299/102 |
| 4,693,518 | A * | 9/1987 | Sulosky et al. | 299/102 |
| 4,915,455 | A | 4/1990 | O'Neill et al. | |
| 5,378,050 | A | 1/1995 | Kammerer et al. | |
| 5,683,144 | A | 11/1997 | Kammerer et al. | |
| 6,234,579 | B1 * | 5/2001 | Montgomery, Jr. | 299/106 |
| 6,779,850 | B1 * | 8/2004 | Schibeci et al. | 299/87.1 |
| 7,784,875 | B2 * | 8/2010 | Holl et al. | 299/102 |
| D638,453 | S * | 5/2011 | Buhr et al. | D15/140 |
| 2008/0093912 | A1 | 4/2008 | Willoughby | |
| 2009/0085396 | A1 * | 4/2009 | Chiang | 299/102 |

FOREIGN PATENT DOCUMENTS

| | | | |
|---|---|---|---|
| DE | 2940288 | A1 | 5/1980 |
| DE | 4322401 | A1 | 1/1995 |
| DE | 202007013350 | U1 | 3/2008 |

OTHER PUBLICATIONS

U.S. Appl. No. 29/380,453, filed Dec. 6, 2010, to Buhr et al.
U.S. Appl. No. 12/960,765, filed Dec. 6, 2010, to Lehnert et al.

* cited by examiner

*Primary Examiner* — John Kreck
(74) *Attorney, Agent, or Firm* — Waddey & Patterson, P.C.; Lucian Wayne Beavers

(57) ABSTRACT

The invention relates to a bit holder having an insertion projection and having a holding projection, the holding projection comprising a bit receptacle, and the holding projection protruding at least locally from or beyond the insertion projection in the tool feed direction. A bit holder of this kind is designed in service-life-optimized fashion by the fact that the holding projection comprises a supporting segment having a rigid, shaped-on supporting surface that is arranged at least locally in front of the insertion projection in the feed direction. The invention further relates to a base part for receiving an aforementioned bit holder.

20 Claims, 5 Drawing Sheets

BIT HOLDER AND BASE PART

Figure 1:
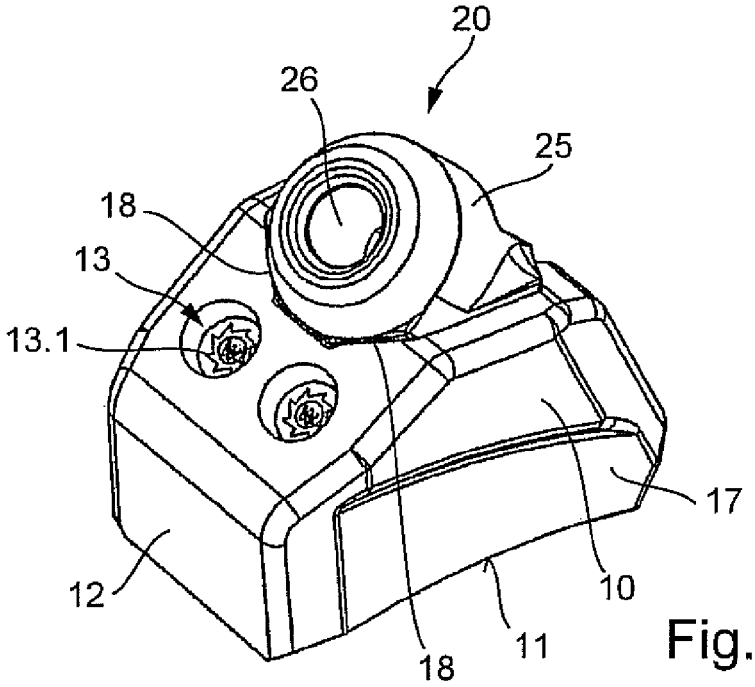

The invention relates to a bit holder having an insertion projection and having a holding projection, the holding projection comprising a bit receptacle, and the holding projection protruding at least locally from or beyond the insertion projection in the tool feed direction.

The invention also relates to a base part having an insertion receptacle, and to a supporting projection that forms an abutment. Such base parts serve to receive bit holders.

U.S. Pat. No. 3,992,061 discloses a tool combination made up of a base part and a bit holder inserted thereinto. The base part comprises for this purpose an insertion receptacle onto which is attached on the front side a base part segment having a threaded receptacle. The threaded receptacle opens into the insertion receptacle. The bit holder is equipped with an insertion projection that can be inserted into the insertion receptacle of the base part. Attached onto the insertion projection is a holding projection that is provided with a bit receptacle in the form of a through hole. The holding projection protrudes locally beyond the insertion projection in the tool feed direction. Oppositely to the feed direction, both the holding projection and the insertion projection are provided with supporting surfaces. A screw is screwed into the threaded receptacle of the base part in order to immobilize the bit holder. This screw presses the bit holder with its supporting surfaces against correspondingly embodied countersurfaces of the base part. While the tool is in use, a force acts on the bit that is inserted into the bit holder. This force occurs when the bit engages into the material that is to be removed. The direction of the force varies during tool operation, thereby producing in particular an alternating stress. It has been shown that in such tool combinations the fastening screw can loosen as a result of the alternating stress, so that the bit holder is no longer securely immobilized in the base part. In addition, such bit holders are not dimensioned sufficiently for clearing work at a high rate of tool advance, as required e.g. for surface mining. In particular, tool breakage often occurs in the transition region between the holding projection and insertion projection.

Systems have therefore been developed in which the bit holder is braced over a large area, oppositely to the tool feed direction behind the insertion projection, with respect to the base part; this is shown e.g. by U.S. Pat. No. 5,378,050.

Dovetail joins between the base part and the bit holder are also known from the existing art. One such configuration is shown, for example, in U.S. Pat. No. 4,915,455. These dovetail joins are very vulnerable. The fitting surfaces between the base part and the tool holder become deflected as a result of the alternating stress, resulting in premature total failure of the system.

In U.S. Pat. No. 3,498,677, in order to improve load transfer between the bit holder and the base part, the holding projection was shaped onto the insertion projection of the bit holder so that the latter protrudes oppositely to the tool feed direction.

It is an object of the invention to make available a bit holder that can reliably withstand the large loads that occur especially in surface mining.

A further object of the invention is to create a base part for a bit holder with which the bit holder can be braced in load-optimized fashion.

The object relating to the bit holder is achieved in that the holding projection comprises a supporting segment having a supporting surface that is arranged at least locally in front of the insertion projection in the feed direction. The portion of the holding projection cantilevered out in the feed direction can as a result be intercepted, with its rigid shaped-on supporting surface, on a correspondingly embodied countermember of a base part. The point at which the maximum energies occurring during tool use are transferred is thus located close to the bit head. This results in a considerable reduction in the effective torques. This strength-optimized design of the bit holder results in much longer service lives, and increases operating reliability.

According to a preferred variant of the invention, provision is made that the supporting segment comprises two supporting surfaces that are at an angle to one another. Centered and zero-clearance alignment of the bit holder against corresponding countersurfaces of a base part is thereby produced. This arrangement can withstand large loads even when they act transversely to the principal direction.

The supporting surfaces are preferably arranged on both sides of the transverse center plane that extends through the longitudinal center axis of the bit receptacle and in the direction of the longitudinal extension of the insertion projection. This symmetrical configuration produces uniform energy dissipation through both supporting surfaces. A conceivable variant of the invention provides that the supporting surface or surfaces form a slide guide whose sliding direction extends oppositely to the tool feed direction (v). Upon installation of the bit holder, the latter can be placed with its supporting surfaces against countersurfaces of a base part. The bit holder is then clamped against a base part, in which context it can be displaced steplessly in its slide guide into the specified position. This ensures defined and reliable installation. The slide guide thus serves to guide the bit holder into its specified installed position. In the installed position, the bit holder is fixedly joined to the base part so that no further relative motion between these components is possible.

Provision can be made according to the present invention that the supporting surface or surfaces is/are part of an enlargement that protrudes beyond the bit receptacle in a direction transverse to the longitudinal center axis of the bit receptacle. The enlargements form chip discharge surfaces that protect a base part from abrasive wear.

A conceivable inventive alternative can be such that the insertion projection comprises, in the region of its insertion projection front side facing in the tool feed direction, at least one pressure surface that is arranged at an angle of less than 90 degrees, preferably less than 80 degrees, with respect to the longitudinal center axis of the insertion projection. This pressure surface serves to clamp the bit holder to a base part. Because it is incident at an angle to the insertion projection, on the one hand draw-in forces can be introduced via the pressure surfaces in the direction of the longitudinal axis of the insertion projection (for example using a compression screw). In addition, upon impingement on the pressure surface, an energy component is generated transversely to the longitudinal extension of the insertion projection, which component can push the insertion projection oppositely to the feed direction into a countermember of a base part. Double immobilization of the bit holder is thereby produced, namely on the one hand via the rear-side clamping against the countermember and on the other hand by way of the supporting surface of the supporting segment arranged in front of the insertion projection.

The insertion projection preferably comprises for this purpose, in the region of its insertion projection rear side facing away from the tool feed direction, a further supporting segment having one or more bearing surfaces.

It is conceivable in this context for the bearing surfaces to be at an angle to one another, thereby in turn producing a centering of the bit holder with respect to the base part as well as optimized energy dissipation thanks to large transfer surfaces for the energy being applied.

The bearing surfaces preferably extend substantially in the direction of the longitudinal axis of the insertion projection. Sliding guidance in the longitudinal direction of the insertion projection is thereby produced. If a base part then, as a result of wear, erodes on the front side in the region of its abutment associated with the supporting segment of the bit holder, the usability of the base part for new, unworn bit holders is then nevertheless maintained. Setting back can be compensated for by way of the rear-side sliding guidance.

The object of the invention relating to the base part is achieved in that the supporting projection forming the abutment is arranged in front of the insertion receptacle in the tool feed direction, and the abutment is configured in front of the insertion receptacle. The base part thus offers the possibility for energy-optimized dissipation of energy, since the supporting projection with its abutment can be brought close to the bit tip. In particular, the advantages described above are established when a corresponding bit holder is used on the base part.

The abutment preferably forms a supporting surface that encloses an obtuse angle with the longitudinal axis of the insertion projection. This obtuse angle, which should preferably be in the range between 200° and 250°, enables energy discharge optimized to the varying direction of forces during tool use. If provision is made that there is arranged, behind the insertion receptacle oppositely to the feed direction, a projection that holds at least one countermember in the region of the insertion receptacle. the aforementioned double bracing of a bit holder then becomes possible. In particular, the latter can be clamped at the front against the supporting projection and at the rear against the countermember. The result is on the one hand that large-area energy transfer surfaces are created, and on the other hand that varying force directions can be optimally intercepted.

A preferred configuration of the invention is such that the abutment and/or the countermember comprises two supporting surfaces that are at an angle to one another. This arrangement of supporting surfaces results in centering of the bit holder with respect to the base part. In addition, large energy transfer surfaces are possible by way of the beveled supporting surfaces. The angular arrangement can be selected so as to enable a strength-optimized configuration of the base part with a small overall volume.

In order to allow secure fastening of the bit holder on the base part, one variant of the invention is such that the supporting projection comprises, in front of the insertion projection in the tool feed direction, a screw receptacle that opens into the region of the insertion receptacle.

Figure 2:
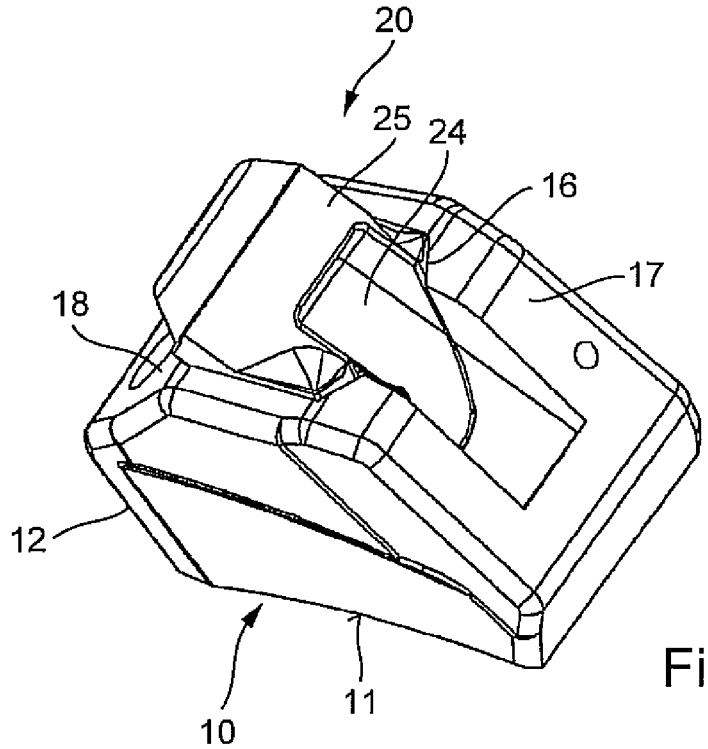
Figure 3:
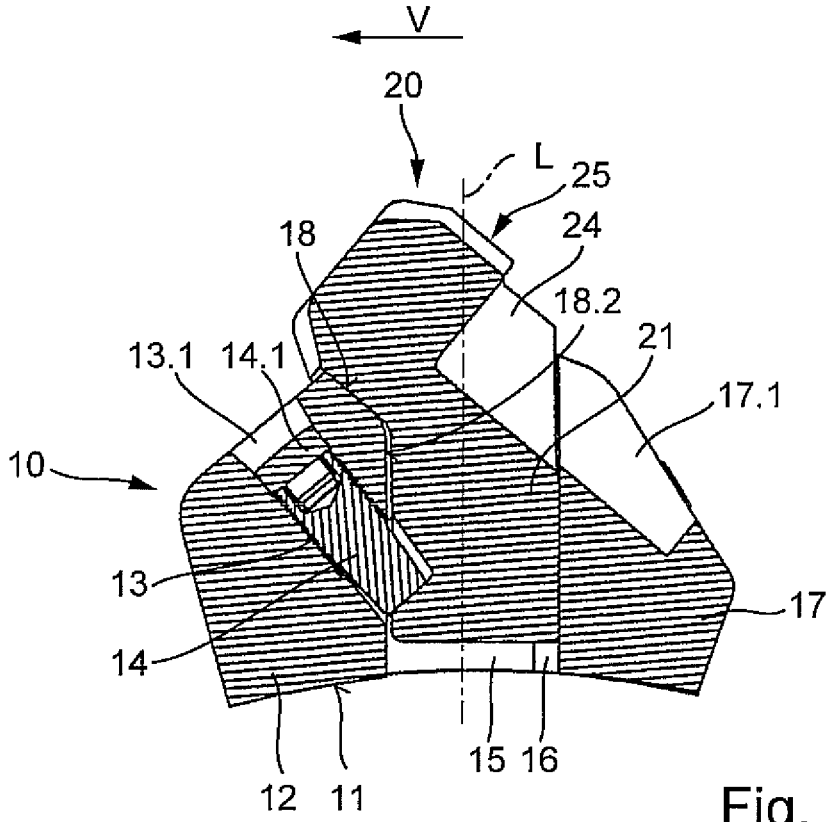
Figure 4:
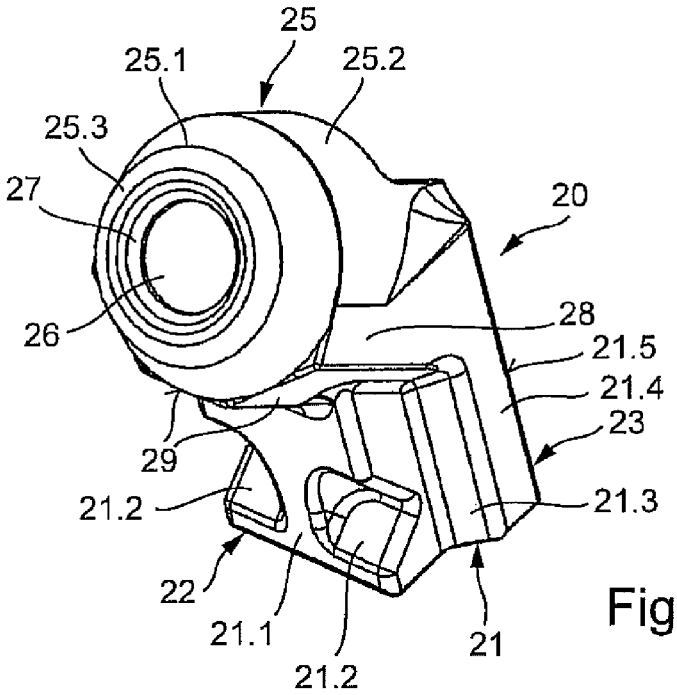
Figure 5:
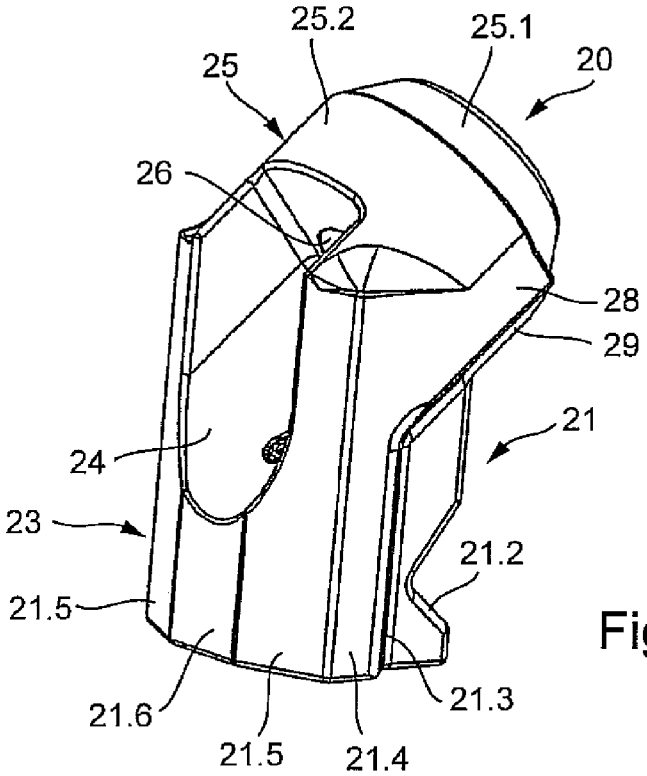
Figure 6:
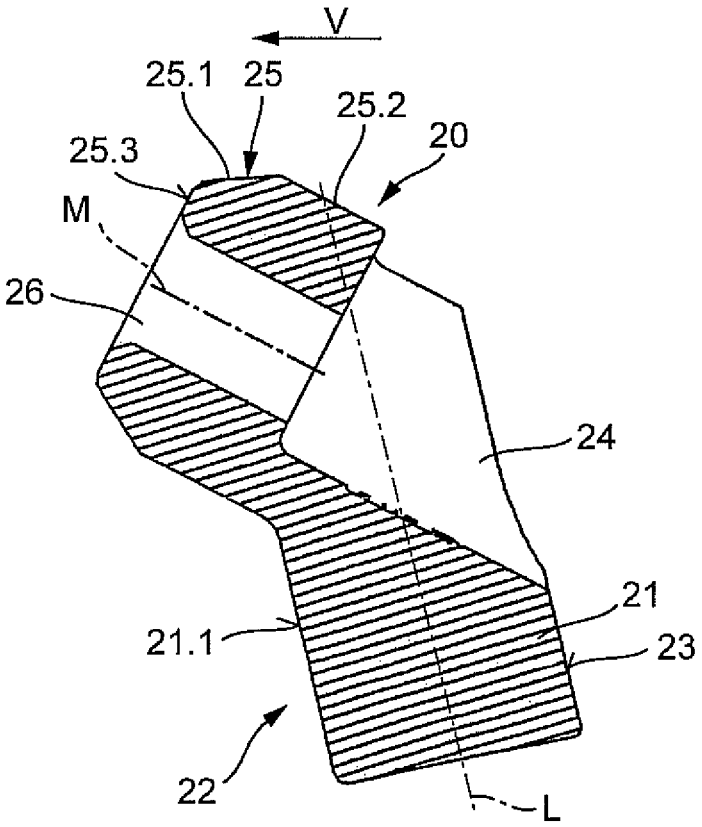
Figure 7:
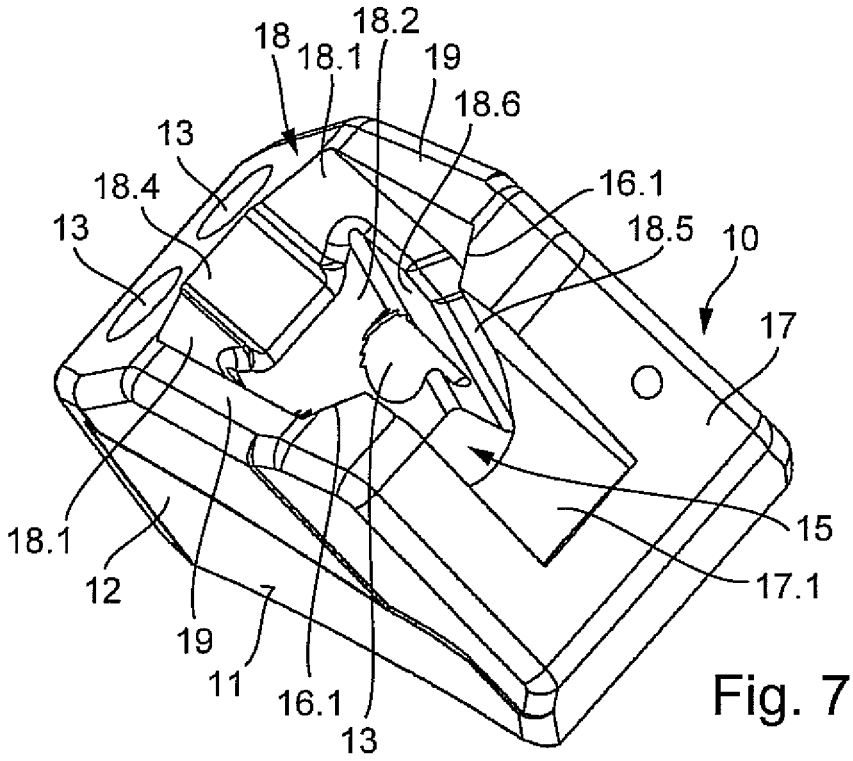

The invention will be explained in more detail below with reference to an exemplifying embodiment depicted in the drawings, in which:

FIG. 1 is a perspective front view of a tool combination having a base part and a bit holder, FIG. 2 is a perspective rear view of the tool combination according to FIG. 1, FIG. 3 is a vertical section through the tool combination according to FIG. 1 or 2, FIG. 4 is a perspective front view of the bit holder in accordance with the tool combination according to FIGS. 1 to 3, FIG. 5 is a rear view of the bit holder according to FIG. 4, FIG. 6 is a vertical section through the bit holder according to FIG. 4 or 5, FIG. 7 is a perspective top view of the base part according to FIGS. 1 to 3, and FIG. 8 is a vertical section through the base part according to FIG. 7.

FIG. 1 shows a base part 10 that has an underside 11 having concavely curved placement surfaces. By means of these placement surfaces, the base part can be placed onto the cylindrical outer enveloping surface of a milling drum and fixedly welded thereonto. A bit holder 20 is joined to base part 10.

As FIG. 3 shows, base part 10 comprises an insertion receptacle 15 that receives an insertion projection 21 of bit holder 20. The configuration of bit holder 20 will be explained in more detail below with reference to FIGS. 4 to 6.

As FIG. 4 shows, bit holder 20 comprises insertion projection 21, onto which a holding projection 25 is attached at an angle. Ideally, an obtuse angle is enclosed between insertion projection 21 and holding projection 25. Insertion projection 21 forms, in the region of its insertion projection front side 22 facing in the tool feed direction (v), a front surface 21.1. Two cutouts are recessed into this front surface 21.1 in such a way that they form pressure surfaces 21.2. Pressure surfaces 21.2 are arranged an angle to the longitudinal axis of insertion projection 21. The protrusion of insertion projection 21 that carries pressure surface 21.2 transitions via lateral transition segments 21.3 into lateral surfaces 21.4. Lateral surfaces 21.4 are aligned in the direction of the tool feed direction (v), and face toward the tool sides. As is evident from FIG. 5, lateral surfaces 21.4 transition in the region of insertion projection rear side 23 into bearing surfaces 21.5. Bearing surfaces 21.5 are at an angle to one another. Bearing surfaces 21.5 are in turn joined by means of a transition surface 21.6, and face oppositely to feed direction v.

Holding projection 25 is equipped with a bit receptacle 26 in the shape of a cylindrical bore. Longitudinal center axis M of bit receptacle 26 and longitudinal axis L of insertion projection 21 ideally enclose an angle in the range between 100° and 160°, preferably 130°. Bit receptacle 26 transitions via an introduction expansion 27 into an abutting surface 25.3. Abutting surface 25.3 extends radially with respect to bit receptacle 26. Facing away from bit receptacle 26, abutting surface 25.3 transitions into a cross-sectional constriction 25.1. Cross-sectional constriction 25.1 is embodied in the shape of a truncated cone and transitions enveloping surface 25.2 of bit holder 20 into abutting surface 25.3. Holding projection 25 comprises, in the region below bit receptacle 26, two supporting surfaces 29 that are incident at a V-shaped angle to one another. As is evident from FIG. 6, because of their oblique incidence, supporting surfaces 29 face toward the free end of the insertion projection and at the same time in the feed direction (v), and (as depicted in FIG. 3) extend parallel or substantially parallel to longitudinal center axis M of bit receptacle 26. As is evident from FIG. 5, holding projection 25 possesses lateral enlargements 28 into which supporting surfaces 29 continue. Supporting surfaces 29 and bearing surfaces 21.5 are oriented so as to face in mutually opposite directions.

Figure 8:
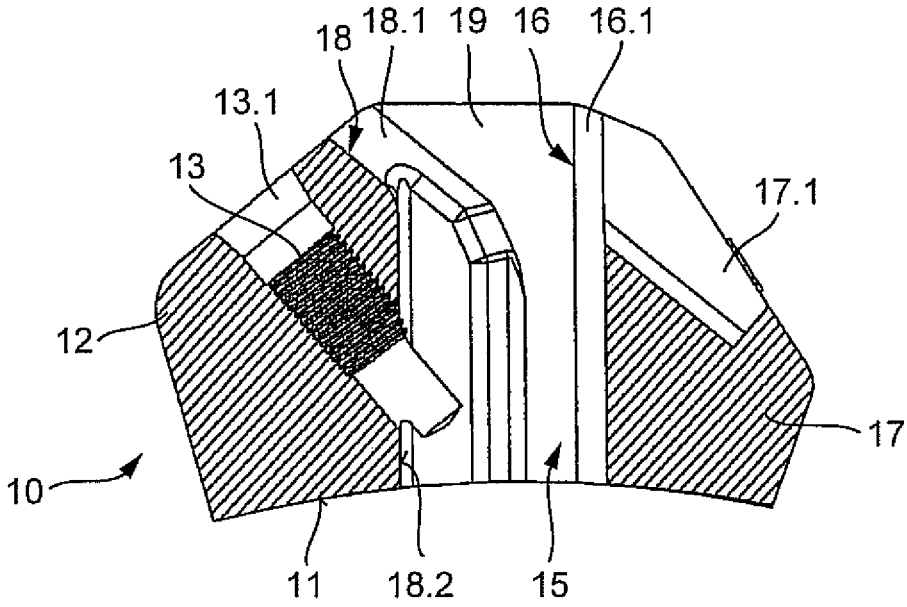

The conformation of base part 10 will be explained in further detail below with reference to FIGS. 7 and 8.

Base part 10 comprises an insertion receptacle 15 that is embodied, in its cross section, in a manner adapted to the outer contour of insertion projection 21 of bit holder 20. On the front side, insertion receptacle 15 is delimited by means of a supporting projection 12. A screw receptacle 13, constituting a thread, is recessed into supporting projection 12. Screw receptacle 13 opens into insertion receptacle 15. Facing away from insertion receptacle 15, screw receptacle 13 continues into a bore expansion 13.1. Supporting projection 12 comprises, in its upper, radially externally located region, an abutment 18 that is formed by two supporting surfaces 18.1. The two supporting surfaces 18.1 are incident at an angle to one another. The angular alignment of supporting surfaces 18.1 is adapted to the alignment of supporting surfaces 29 of bit holder 20, so that supporting surfaces 29 of bit holder 20 can abut in plane-parallel fashion against supporting surfaces 18.1 of base part 10. For the purpose of defined contact of bit holder 20, supporting surfaces 18.1 are joined to one another via a set-back recess 18.4.

Insertion receptacle 15 is delimited on the rear side by a countermember 16. Countermember 16 is part of a rearward projection 17 that protrudes, oppositely to the feed direction (v), beyond insertion receptacle 15. Countermember 16 is constituted by two further supporting surfaces 16.1 that are at an angle to one another. These further supporting surfaces 16.1 are again embodied, in terms of their configuration and spatial arrangement, in a manner adapted to bearing surfaces 21.5 of bit holder 20, thus enabling plane-parallel contact of further bearing surfaces 21.5 against supporting surfaces 16.1. Opposite to supporting surfaces 18.1, insertion receptacle 15 is delimited by an exposed surface 18.2. In the tool feed direction (v), insertion receptacle 15 is delimited by two lateral connecting segments 19. The inner surfaces, which are formed by connecting segments 19 and which face toward insertion receptacle 15, transition via exposed surfaces 18.5 into walls 18.6 that are in turn oriented in the tool feed direction (v). Walls 18.6 in turn continue into exposed surface 18.2. As is clearly evident from FIG. 7, a cutout 17.1 is recessed into projection 17.

Installation of bit holder 20 on base part 10 is performed as follows.

Firstly, bit holder 20 is slid with its insertion projection 21 into insertion receptacle 15 of base part 10. As is evident from FIG. 3, a setscrew, constituting a fastening element 14, is then screwed into screw receptacle 13. Fastening element 14 comprises a compression surface, oriented at right angles to the screw axis, that comes into contact against pressure surface 21.2 of bit holder 20. The compression surface does not need to be a flat surface, but can also be a spherical surface. It is evident from FIG. 1 that two fastening elements 14 are used to fasten tool holder 20, so consequently two screw receptacles 13 are also recessed into base part 10. Upon tightening of fastening elements 14, fastening element 14 presses onto pressure surface 21.2. Because of the angled incidence of pressure surface 21.2 with respect to the longitudinal center axis of insertion projection 21, fastening element 14 exerts a draw-in force on insertion projection 21. At the same time, a force component is generated that extends oppositely to the feed direction (v) and presses insertion projection 21 into countermember 16. The force component extending in the direction of the longitudinal axis of insertion projection 21 brings supporting surfaces 18.1 of abutment 18 into contact against supporting surfaces 29 of bit holder 20. As is clearly evident in particular from FIG. 3, a tightening of fastening elements 14 now causes bit holder 20 to experience bracing on both sides of the longitudinal center axis of insertion projection 21. Bracing is effected on the one hand against countermember 16 in back of the longitudinal center axis, and on the other hand against abutment 18 in front of the longitudinal center axis. Fastening screw 14 now acts on insertion projection 21 in such a way that a clamping of bit holder 20 against abutment 18 and against countermember 16 takes place. This guarantees secure and lossproof fastening of bit holder 20.

It is further evident from FIG. 3 that a cover element 14.1, which covers the tool receptacle of fastening element 14, can be inserted into bore expansion 13.1 of screw receptacle 13.

Both base part 10 and bit holder 20 are embodied substantially mirror-symmetrically with respect to the transverse center plane, extending in the feed direction (v), of these respective components. This promotes uniform load dissipation.

During operational use, a point-attack cutting tool of usual construction, inserted into bit receptacle 26, engages into the material to be removed, for example a coal seam. It is principally the bracing system made up of abutment 18 and supporting surfaces 29 that is stressed in the context of this engagement. During tool engagement, bit holder 20 is also pressed into countermember 16 as a consequence of the feed (v). The large-area contact of bit holder 20 at that location guarantees reliable force dissipation.

As is evident from FIG. 3, an unequivocal association between bit holder 20 and base part 10 is guaranteed in particular by the fact that only one abutment takes place at these two aforementioned central supporting points (abutment 18 and countermember 16). In the region of recess 18.4, exposed surface 18.2, walls 18.6, exposed surfaces 18.5, and connecting segment 19, insertion projection 21 is disengaged from insertion receptacle 15. If abrasion of supporting surfaces 18.1, for example, then takes place as base part 10 being used, recess 18.4 thus forms a setback space. The spacing between bit holder 20 and recess 18.4 ensures that bit holder 20 can be reset in the event of wear. Wear compensation can take place in particular because supporting surface 18.1 and further supporting surfaces 16.1 form slide guides on which bit holder 20 can slip upon retensioning. This configuration is advantageous in particular when, as is usually required, base part 10 has a service life that extends over multiple life cycles of bit holders 20. Unworn bit holders 20 can then always be securely clamped and held, even on a partly worn base part 10.

During operational use, removed material that slips off bit holder 20 in the region of enveloping surface 25.2 is cleared by the built-in point-attack bit. This removed material is directed outward via enlargements 28, thereby protecting base part 10 from the abrasive attack of this removed material.

When a point-attack bit is worn, it can easily be replaced. This is possible because cutouts 17.1 in base part 10 form, together with opening 24 in bit holder 20, a tool receptacle. Into this can be inserted an ejector tool that acts on the rear side of the point-attack bit and pushes it out of bit receptacle 26. As is evident from FIG. 5, bit receptacle 26 is spatially connected to opening 24.

The invention claimed is:

1. A bit holder, comprising:

an insertion projection having a longitudinal insertion axis defining a linear insertion direction;

a holding projection including a bit receptacle, the holding projection protruding from the insertion projection in a tool feed direction, and the holding projection including a rigid integral supporting segment including at least one supporting surface arranged in front of the insertion projection in the tool feed direction; and wherein the insertion projection comprises an insertion projection rear side facing away from the tool feed direction, the rear side including a further supporting segment having one or more planar bearing surfaces extending parallel to the longitudinal insertion axis.

2. The bit holder according to claim 1, wherein the at least one supporting surface of the supporting segment comprises two supporting surfaces that are at an angle to one another.

3. The bit holder according to claim 2, wherein the supporting surfaces are arranged on both sides of a transverse center plane that extends through a longitudinal center axis of the bit receptacle and the longitudinal insertion axis of the insertion projection.

4. The bit holder according to claim 2, wherein the supporting surfaces form a slide guide.

5. The bit holder according to claim 2, wherein the supporting surfaces are part of an enlargement that protrudes beyond the bit receptacle in a direction transverse to a longitudinal center axis of the bit receptacle.

6. The bit holder according to claim 1, wherein the insertion projection comprises a front side facing in the tool feed direction, the front side including at least one pressure surface arranged at an angle of less than 90 degrees with respect to the longitudinal insertion axis of the insertion projection, the pressure surface facing opposite to the linear insertion direction so that a force acting against the pressure surface forces the insertion projection in the linear insertion direction.

7. The bit holder according to claim 6, wherein the at least one pressure surface is arranged at an angle of less than 80 degrees with respect to the longitudinal insertion axis of the insertion projection.

8. The bit holder according to claim 1, wherein the bit receptacle includes an opening that is open oppositely to the tool feed direction.

9. The bit holder according to claim 1, wherein the one or more planar bearing surfaces include two planar bearing surfaces at an angle to one another.

10. The bit holder according to claim 1, wherein:

the at least one supporting surface is oriented in a direction facing at least partly in the tool feed direction, and the one or more planar bearing surfaces are oriented in a direction facing at least partly away from the tool feed direction.

11. The bit holder according to claim 1, wherein:

the at least one supporting surface and the one or more planar bearing surfaces are located on opposite sides of the longitudinal insertion axis of the insertion projection.

12. The bit holder according to claim 1, wherein:

the insertion projection has a longitudinal inner end;

the at least one supporting surface is located on an opposite side of the longitudinal insertion axis from the one or more planar bearing surfaces; and the one or more planar bearing surfaces are located longitudinally closer to the longitudinal inner end of the insertion projection than is the at least one supporting surface.

13. A base part for a bit holder, comprising:

an insertion receptacle having a longitudinal insertion axis;

a first projection including an abutment, the first projection and the abutment being located in front of the insertion receptacle in a tool feed direction; and a second projection located behind the insertion receptacle oppositely to the tool feed direction, the second projection including at least one countermember including at least one planar countermember supporting surface facing into the insertion receptacle and extending parallel to the longitudinal insertion axis.

14. The base part according to claim 13, wherein:

the abutment includes two abutment supporting surfaces oriented at an angle to each other.

15. The base part according to claim 13, wherein:

the abutment includes at least one abutment supporting surface that encloses an obtuse angle with the longitudinal insertion axis of the insertion receptacle.

16. The base part according to claim 13, wherein:

the first projection includes a screw receptacle that opens into the insertion receptacle, the screw recetacle defining a screw axis extending upward and forward from the insertion receptacle so that a force acting along the screw axis toward the insertion receptacle has a downward component downward into the insertion receptacle and a rearward component toward the at least one planar countermember supporting surface.

17. The base part according to claim 13, wherein:

the at least one planar countermember supporting surface includes two planar countermember supporting surfaces oriented at an angle to each other.

18. A tool assembly comprising:

a base part, including an insertion receptacle having a longitudinal insertion axis; and a first projection including an abutment located in front of the insertion receptacle in a tool feed direction; and a bit holder, including:

an insertion projection received in the insertion receptacle in a linear insertion direction parallel to the longitudinal insertion axis; and a holding projection including a bit receptacle, the holding projection protruding from the insertion projection in the tool feed direction, and the holding projection including a rigid integral supporting segment including at least one holding projection supporting surface engaging the abutment of the base part;

wherein the base part includes a second projection located behind the insertion receptacle, the second projection including at least one planar countermember supporting surface; and wherein the insertion projection of the bit holder includes at least one rearward facing insertion projection supporting surface engaging the at least one planar countermember supporting surface.

19. The tool assembly according to claim 18, wherein:

the abutment of the base part includes two planar abutment supporting surfaces located at an angle to each other; and the at least one holding projection supporting surface of the bit holder includes two planar holding projection supporting surfaces engaging and parallel to the two planar abutment supporting surfaces.

20. The tool assembly according to claim 18, wherein:

the insertion projection of the bit holder comprises a front side facing in the tool feed direction, the front side including at least one pressure surface facing oppositely to the linear insertion direction and arranged at an angle of less than 90 degrees with respect to the longitudinal insertion axis of the insertion projection;

the first projection of the base part includes at least one screw receptacle opening into the insertion receptacle; and the tool assembly further includes at least one screw received in the at least one screw receptacle and engaging the at least one pressure surface to force the bit holder downwardly and rearwardly to hold the bit holder in place within the base part.

* * * * *

UNITED STATES PATENT AND TRADEMARK OFFICE

CERTIFICATE OF CORRECTION

PATENT NO. : 8,746,806 B2
APPLICATION NO. : 12/960756
DATED : June 10, 2014
INVENTOR(S) : Lehnert et al.

It is certified that error appears in the above-identified patent and that said Letters Patent is hereby corrected as shown below:

In the Claims:

Column 8, line 7, replace “recetacle” with --receptacle--.

Signed and Sealed this
Twenty-first Day of October, 2014

Michelle K. Lee

Michelle K. Lee
*Deputy Director of the United States Patent and Trademark Office*